US009525198B2

(12) United States Patent
Chiu et al.

(10) Patent No.: US 9,525,198 B2
(45) Date of Patent: Dec. 20, 2016

(54) CAVITY FILTER

(71) Applicant: HON HAI PRECISION INDUSTRY CO., LTD., New Taipei (TW)

(72) Inventors: Mu-Jung Chiu, New Taipei (TW); Jane-Yi Pieh, New Taipei (TW); Ruei-Yun Hung, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 95 days.

(21) Appl. No.: 14/160,568

(22) Filed: Jan. 22, 2014

(65) Prior Publication Data

US 2014/0292446 A1 Oct. 2, 2014

(30) Foreign Application Priority Data

Mar. 29, 2013 (TW) ..... 102111277 U

(51) Int. Cl.
*H01P 1/205* (2006.01)
*H01P 7/04* (2006.01)

(52) U.S. Cl.
CPC ..... *H01P 1/2053* (2013.01); *H01P 7/04* (2013.01)

(58) Field of Classification Search
CPC ..... H01P 1/202; H01P 1/205; H01P 1/1053; H01P 7/04
USPC ..... 333/206, 207, 222–224
See application file for complete search history.

(56) References Cited

U.S. PATENT DOCUMENTS

| | | | | |
|---|---|---|---|---|
| 6,384,699 | B1 * | 5/2002 | Henningsson | H01P 7/06 333/202 |
| 7,777,598 | B2 | 8/2010 | Salehi et al. | |
| 7,982,560 | B2 | 7/2011 | Hesselbarth | |
| 2004/0113723 | A1 * | 6/2004 | Motooka | H01P 1/00 333/202 |
| 2008/0024248 | A1 * | 1/2008 | Sieber | H01P 1/2053 333/207 |
| 2010/0271153 | A1 | 10/2010 | Wong | |
| 2012/0068792 | A1 | 3/2012 | Yassini | |
| 2012/0169435 | A1 * | 7/2012 | Kaneda et al. | 333/202 |
| 2012/0313732 | A1 | 12/2012 | Cheng et al. | |
| 2013/0234807 | A1 | 9/2013 | Wong | |
| 2015/0109075 | A1 * | 4/2015 | Chen et al. | 333/203 |

FOREIGN PATENT DOCUMENTS

| | | | |
|---|---|---|---|
| CN | 1231526 | A | 10/1999 |
| CN | 201421872 | Y | 3/2010 |
| CN | 102025012 | A | 4/2011 |
| CN | 102324601 | | 1/2012 |
| CN | 202550043 | U | 11/2012 |

(Continued)

*Primary Examiner* — Robert Pascal
*Assistant Examiner* — Gerald Stevens
(74) *Attorney, Agent, or Firm* — Zhigang Ma

(57) ABSTRACT

A cavity filter includes a first layer circuit board, a second layer circuit board and a middle layer circuit board locates between the first layer circuit board and the second layer circuit board. A plurality of resonators locates on the first layer circuit board. A plurality of resonating cavities is located on the second layer circuit board one-to-one corresponding to the resonators. A slot is defined on the middle layer circuit board. The resonators traverse through the slot and are placed in the resonating cavities to form a plurality of resonating units, and the plurality of resonating couple with the slot of the middle layer circuit board.

9 Claims, 9 Drawing Sheets

(56) References Cited

FOREIGN PATENT DOCUMENTS

| | | | | | |
|---|---|---|---|---|---|
| GB | 2276276 | | * | 9/1994 | ..... H01P 1/205 |
| GB | 2276276 | A | | 9/1994 | |
| TW | M377708 | U | | 4/2010 | |
| TW | 201119124 | A | | 6/2011 | |

* cited by examiner

CAVITY FILTER

BACKGROUND

1. Technical Field

The present disclosure generally relates to filters for base station, and more particularly to a cavity filter of a base station.

2. Description of Related Art

Cavity filters are popularly applied in mobile communications. Generally, a cavity filter of a base station comprises a lid and one or more cavity. A resonator is received in each cavity.

The production process of the traditional cavity filter is by die-casting, which causes the traditional cavity filter to have a large volume and weight. Furthermore, it is necessary to provide a mold for the die-casting production, which leads to a high cost.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, all the views are schematic, and like reference numerals designate corresponding parts throughout the several views.

DETAILED DESCRIPTION

Figure 1:
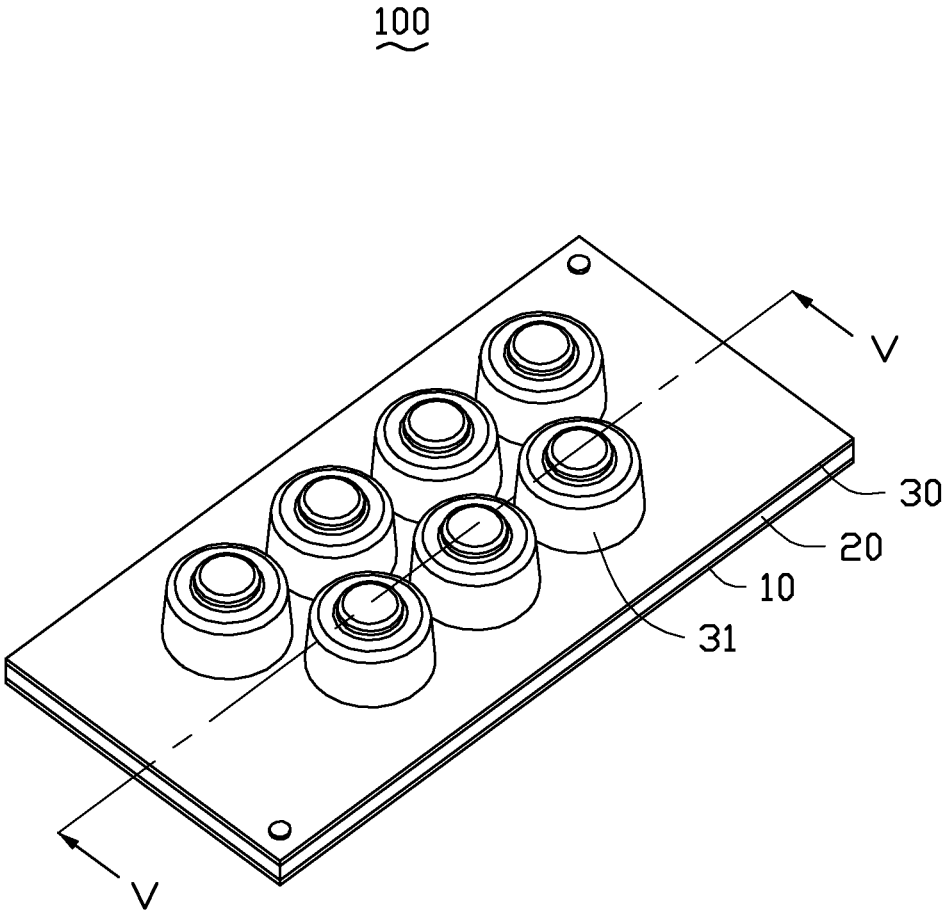
FIG. 1 is a top perspective view of a cavity filter in accordance with a first exemplary embodiment of the disclosure.

The disclosure is illustrated by way of example and not by way of limitation in the figures of the accompanying drawings in which like reference numerals indicate similar elements. It should be noted that references to "an" or "one" embodiment in this disclosure are not necessarily to the same embodiment, and such references can mean "at least one."

Figure 2:
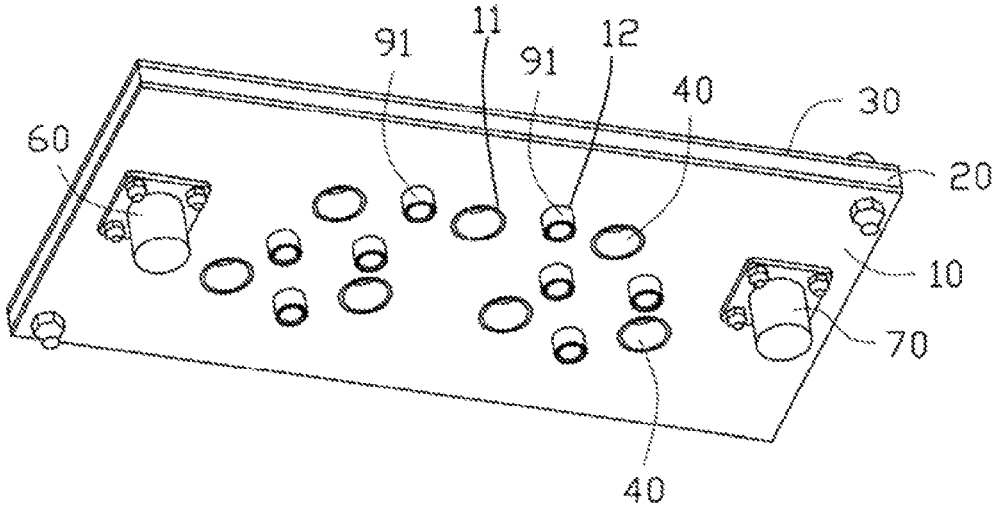
FIG. 2 is a bottom perspective view of the cavity filter of FIG. 1.
Figure 3:
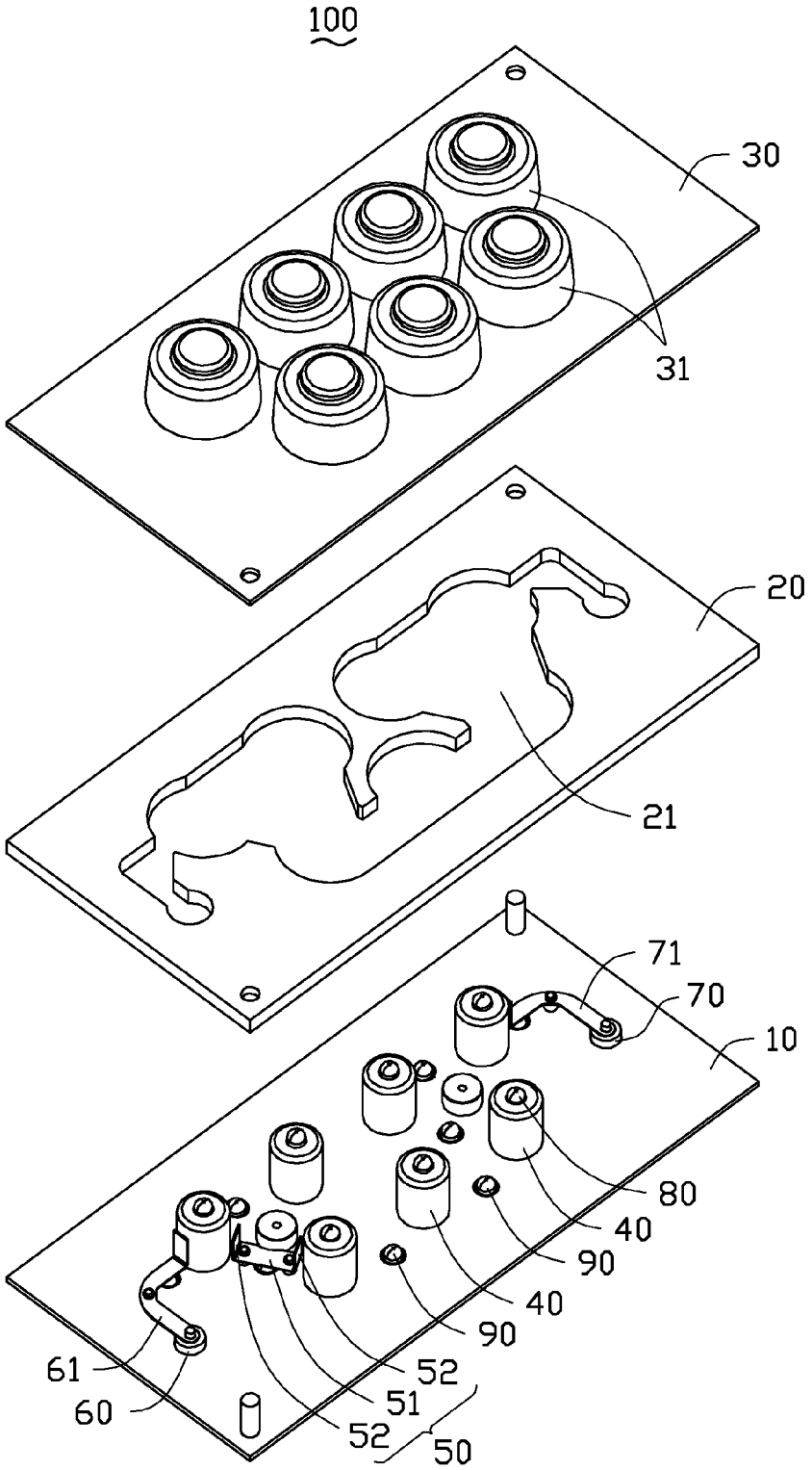
FIG. 3 is an exploded view of the cavity filter of FIG. 1.

FIG. 1, FIG. 2 and FIG. 3 show that a cavity filter 100 in accordance with a first embodiment of the present disclosure comprises a first layer circuit board 10, a middle layer circuit board 20 and a second layer circuit board 30. A plurality of resonators 40 is located on the first layer circuit board 10. The middle layer circuit board 20 defines a slot 21. A plurality of resonating cavities 31 is located on the second layer circuit board 30 each corresponding to one of the plurality of resonators 40 secured on the first layer circuit board 10. In the embodiment, the middle layer circuit board 20 is located above the first layer circuit board 10 and below the second layer circuit board 30. The resonators 40 traverse through the slot 21 and are placed in the resonating cavities 31 respectively to form a plurality of resonating units 200, which extend through the slot 21 of the middle layer circuit board 20. The plurality of resonating units 200 couple with the slot 21 of the middle layer circuit 20.

In summary, the cavity filter 100 is composed with three layer circuit boards and a plurality of resonators 40 secured on the first layer circuit board 10 and the corresponding resonating cavities 31 located on the second layer circuit board 30. As a result, compared with conventional technology, the weight and the cost are greatly reduced.

Figure 5:
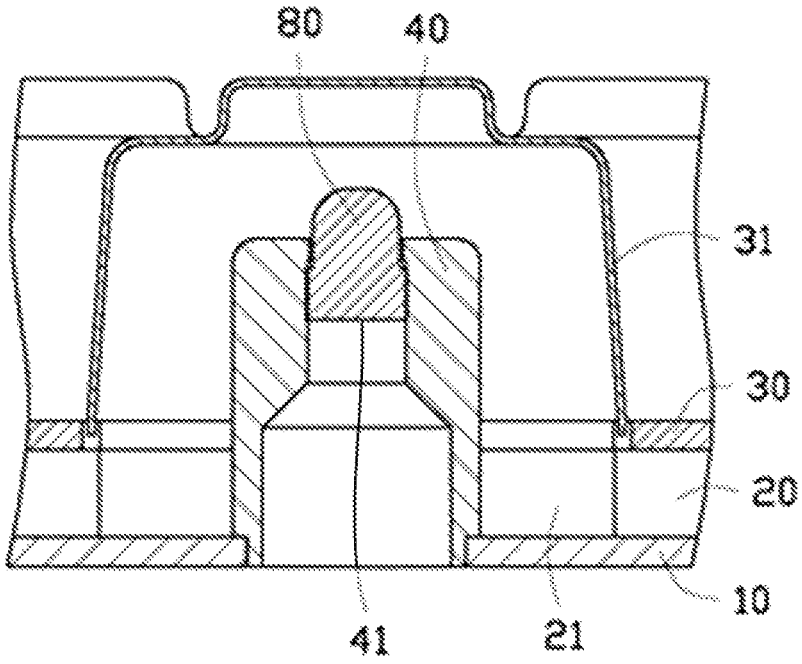
FIG. 5 is a part of a cross-sectional view taken along line V-V of the cavity filter of FIG. 1.

FIG. 2, FIG. 3 and FIG. 5 show that the first layer circuit board 10 provides a plurality of position holes 11 corresponding to the resonators 40, wherein each of the resonators 40 defines a first threaded hole 41 in an upper portion thereof. Bottom ends of the plurality of resonators 40 are installed on the first layer circuit board 10 and in the corresponding position holes 11 of the first layer circuit board 10 and top ends of the plurality of resonators 40 are inserted into the corresponding resonating cavities 31 of the second layer circuit board 30, respectively. The first threaded hole 41 of the resonator 40 is exposed through a bottom of the first layer circuit board 10 defining a corresponding position hole 11. A turning post 80 traverses through the bottom of the first layer circuit board 10 and a lower portion of the resonator 40 to be fixed at a top of the resonator 40 by threadedly engaging with the first threaded hole 41. The turning post 80 can be used to adjust resonating frequency of the cavity filter 100 by adjusting a height of the turning post 80 above the resonator 40 by rotating the turning post 80 clockwise or counterclockwise. In the embodiment, the resonators 40 are mounted on the first layer circuit board 10 over the position holes 11 by welding. Alternatively, the resonators 40 can be mounted on the first layer circuit board 10 by another way, for example gluing.

FIG. 2 and FIG. 3 show a second threaded hole 12 defined between every two adjacent resonators 40 of the first layer circuit board 10, and a nut 91 of a coupling screw 90 secured to a corresponding second threaded hole 12 and protruding downwards from the bottom of the first layer circuit board 10. The coupling screw 90 threadedly engages with the nut 91. A resonating frequency of the cavity filter 100 can be further adjusted by screwing the nuts 91 into or out of the second threaded holes 12 or by screwing the coupling screw 90 into or out of the nut 91, which reduces the distance between resonating cavities 31 and reduces the volume of the cavity filter 100 thereby. The frequency difference caused by the production process of the cavity filter 100 can be compensated by fine adjusting the coupling screws 90.

Figure 4:
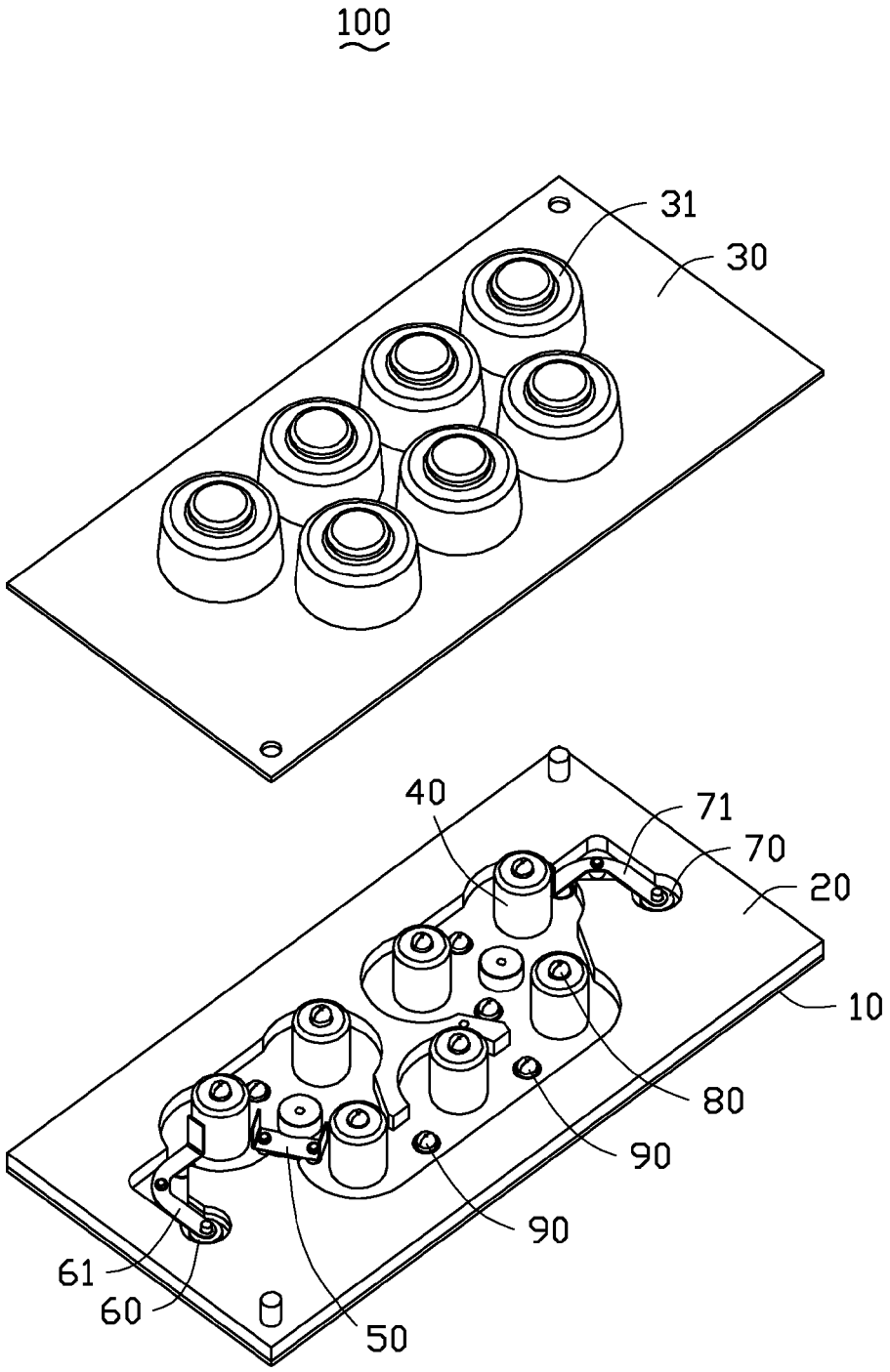
FIG. 4 is a view similar to FIG. 3, with a middle layer circuit board being installed on a first layer circuit board of the cavity filter of FIG. 3.

FIG. 3 and FIG. 4 show that the cavity filter 100 further comprises an input port 60 and an output port 70. The input port 60 connects with the resonators 40 via an input coupling strip 61 to achieve coupling. The output port 70 connects with the resonators 40 via an output coupling strip 71 to achieve coupling.

In the embodiment, the frequency of the cavity filter 100 can be adjusted by manipulating the turning posts 80 and the coupling screws 90 of the cavity filter 100 from the bottom of the first layer circuit board 10; in other words, the manipulating directions of the turning post 80 and the coupling screw 90 are the same, which enables the adjustment of the frequency of the cavity filter 100 to be convenient. The turning post 80 directly engages with an inside of the resonator 40, which leads to a cost reduction.

The size and shape of the slot 21 of the middle layer circuit board 20 can be changed according to the arrangement of the resonators 40 installed on the first layer circuit board 10. When the second layer circuit board 30 is mounted on the middle layer circuit board 20, a space of the slot 21 between two adjacent resonating cavities 31 defines an air channel. When the cavity filter 100 works, every two resonating units 200 achieve a coupling in the slot 21.

The cavity filter 100 further comprises a plurality of coupling strips 50 installed between the two resonators 40 to produce a capacitance coupling or an inductance coupling. When the middle layer circuit board 20 is mounted on the first layer circuit board 10, the coupling strips 50 are received in the slot 21 of the middle layer circuit board 20.

Figure 6:
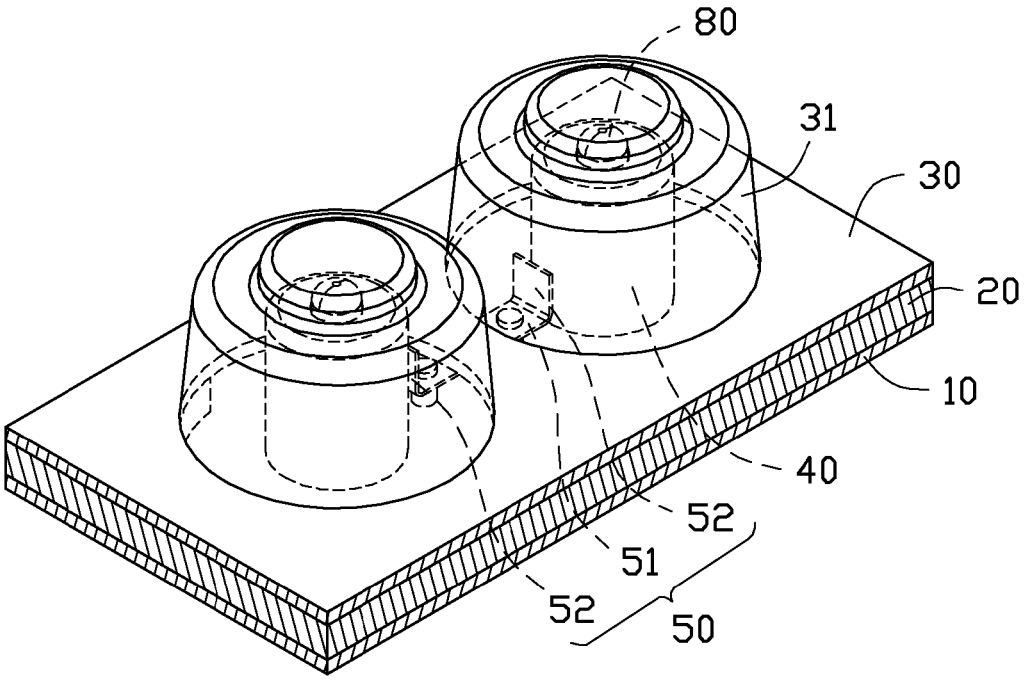
FIG. 6 is an enlarged and partially perspective view with a part cut away of the cavity filter of FIG. 1, which clearly shows a strip-line coupling of the cavity filter of FIG. 1, wherein a length of the coupling strip is less than $\lambda/2$.
Figure 7:
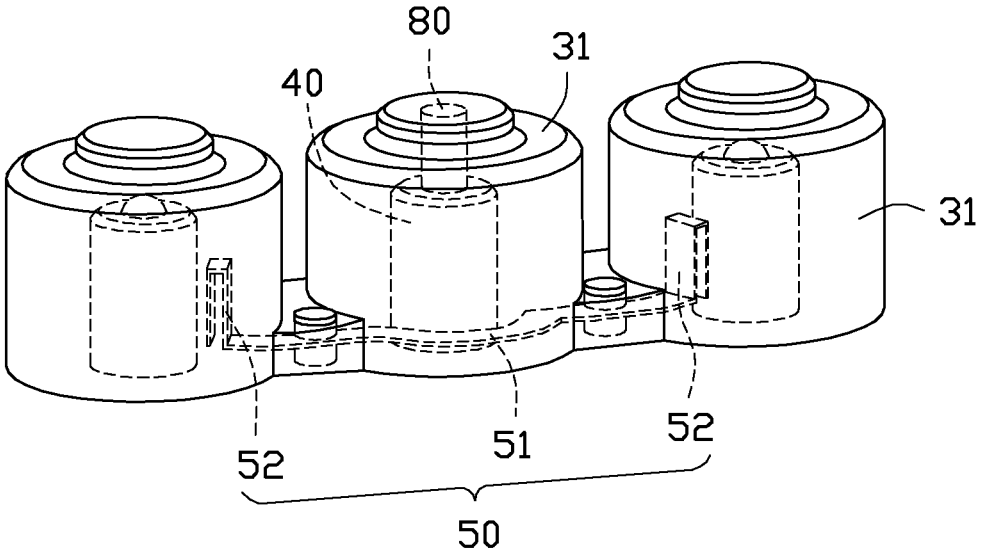
FIG. 7 is an enlarged and partially perspective view of the cavity filter of FIG. 1, showing a strip-line coupling of the cavity filter of FIG. 1, wherein a length of the coupling strip is more than $\lambda/2$.

In the embodiment, each coupling strip 50 includes a body 51 and two free tabs 52 located on two opposite ends of the body 51 of the coupling strip 50. The body 51 secures on the first layer circuit board 10 via electrically insulating material. Each free tab 52 of the coupling strip 50 extends from the body 51 into the slot 21 of the middle layer circuit board 20. The free tabs 52 form a line coupling with the adjacent resonators 40. FIG. 6 shows that when the length of the coupling strip 50 is less than $\lambda/2$ ($\lambda$ indicates the wavelength of the electromagnetic wave), the cavity filter 100 has a capacitance coupling. FIG. 7 shows that when the length of the coupling strip 50 is more than $\lambda/2$, the cavity filter 100 has an inductance coupling.

Figure 8:
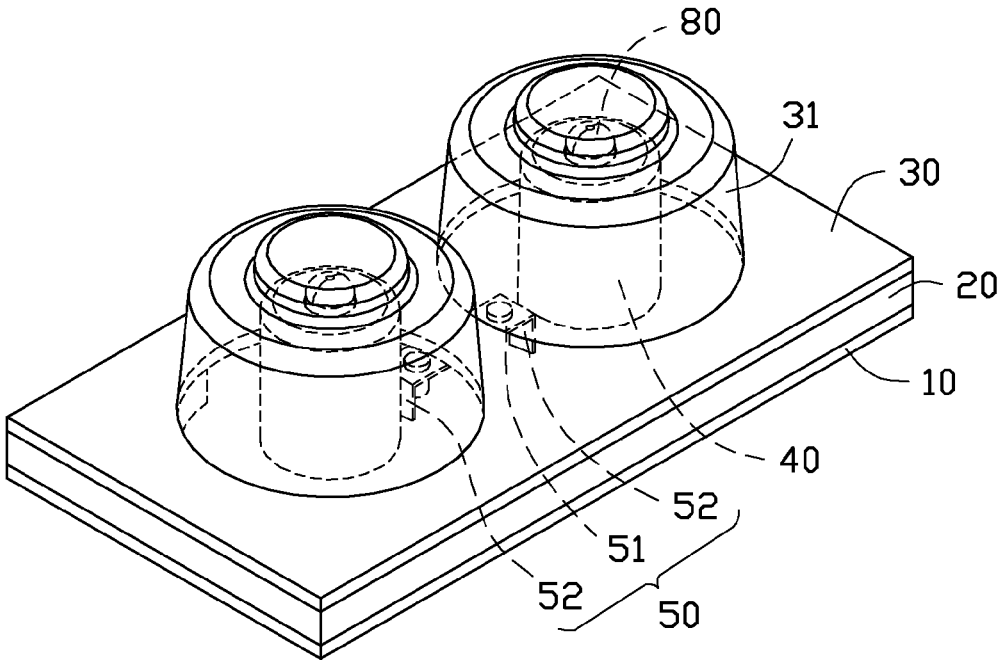
FIG. 8 is a view similar to FIG. 6, with the strip-line coupling being replaced by a loop coupling, wherein a length of the coupling strip is less than $\lambda/2$.
Figure 9:
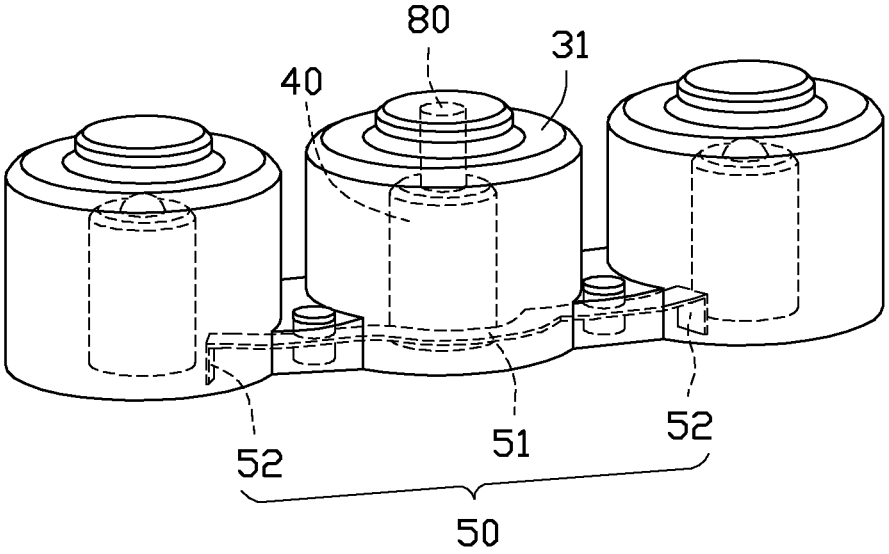
FIG. 9 is a view similar to FIG. 7, with the strip-line coupling being replaced by a loop coupling, wherein a length of the coupling strip is more than $\lambda/2$.

In other embodiments, each free tab 52 of the coupling strip 50 extends from the body 51 to the first layer circuit board 10 and electrically connects with the first layer circuit board 10. The free tabs 52 form a loop coupling with the adjacent resonators 40 which increases the coupling effect. FIG. 8 shows that when the length of the coupling strip 50 is less than $\lambda/2$, the cavity filter 100 has an inductance coupling. FIG. 9 shows that when the length of the coupling strip 50 is more than $\lambda/2$, the cavity filter 100 has a capacitance coupling.

The quantity, position and size of the coupling strip 50 can be defined by the real frequency of the cavity filter 100.

Although the features and elements of the present disclosure are described as embodiments in particular combinations, each feature or element can be used alone or in other various combinations within the principles of the present disclosure to the full extent indicated by the broad general meaning of the terms in which the appended claims are expressed.

What is claimed is:

1. A cavity filter, comprising:

a first layer circuit board;

a second layer circuit board;

a middle layer circuit board located between the first layer circuit board and the second layer circuit board, and the middle layer circuit board defining a slot;

a plurality of resonators located on the first layer circuit board;

a plurality of resonating cavities located on the second layer circuit board, wherein the plurality of resonating cavities one-to-one correspond to the plurality of resonators;

wherein the plurality of resonators traverse through the slot and are placed in the plurality of resonating cavities to form a plurality of resonating units, and the plurality of resonating units couple with the slot of the middle layer circuit.

2. The cavity filter of claim 1, further comprising a plurality of coupling strips secured on the first layer circuit board and are arranged between a corresponding two of the plurality of resonators.

3. The cavity filter of claim 2, wherein each of said plurality of coupling strips comprises a body secured on the first layer circuit board via electrically insulating material.

4. The cavity filter of claim 3, wherein each of said plurality of coupling strips further comprises two free tabs extending from two opposite ends of the body of the coupling strip and toward the slot of the middle layer circuit board to form a strip-line coupling with adjacent ones of said plurality of resonators.

5. The cavity filter of claim 3, wherein each of said plurality of coupling strips further comprises two free tabs extending from two opposite ends of the body of the coupling strip and toward the first layer circuit board to electrically connect with the first layer circuit board to thereby form a loop coupling with adjacent ones of said plurality of resonators.

6. The cavity filter of claim 1, further comprising an input port and an output port, wherein the input port is connected with a first one of the plurality of resonators via an input coupling strip to achieve a coupling and the output port connects with a second one of the plurality of resonators via an output coupling strip.

7. The cavity filter of claim 1, wherein each resonator defines a first threaded hole, the first layer circuit board provides a plurality of position holes corresponding to the first threaded holes of the resonators, and a turning post traverses through the bottom of the first layer circuit board defining a corresponding position hole and inserts into the first threaded hole of a corresponding resonator to threadedly engage with the corresponding resonator, by rotating the turning post, a resonating frequency of the cavity filter being adjusted.

8. The cavity filter of claim 1, wherein a second threaded hole is defined between two adjacent resonators of the plurality of resonators, a nut of a coupling screw is secured on the bottom of the first layer circuit board and the coupling screw traverses through the nut and inserts into the second threaded hole, by rotating the coupling screw, a resonating frequency of the cavity filter being adjusted.

9. A cavity filter, comprising:

a first layer circuit board;

a second layer circuit board;

a middle layer circuit board located between the first layer circuit board and the second layer circuit board, and the middle layer circuit board defining a slot;

a plurality of resonators located on the first layer circuit board;

a plurality of resonating cavities located on the second layer circuit board, wherein the plurality of resonating cavities one-to-one correspond to the plurality of resonators;

wherein the plurality of resonators traverse through the slot and are placed in the plurality of resonating cavities to form a plurality of resonating units, and the plurality of resonating units couple with the slot of the middle layer circuit;

wherein a second threaded hole is defined between two adjacent resonators of the plurality of resonators, a nut of a coupling screw is secured on the bottom of the first layer circuit board and the coupling screw traverses through the nut and inserts into the second threaded hole, by rotating the coupling screw, a resonating frequency of the cavity filter being adjusted.

* * * * *